United States Patent [19]

Flantua

[11] 4,045,941

[45] Sept. 6, 1977

[54] METHOD AND APPARATUS FOR CASING FLEXIBLE CONTAINERS

[75] Inventor: Gysbertus Flantua, Grimsby, Canada

[73] Assignee: Bonar & Bemis Ltd., Burlington, Canada

[21] Appl. No.: 724,136

[22] Filed: Sept. 17, 1976

[30] Foreign Application Priority Data

Feb. 24, 1976 Canada ..... 246435

[51] Int. Cl.[2] ..... B65B 5/10

[52] U.S. Cl. ..... 53/35; 53/202; 53/244; 53/252; 53/263

[58] Field of Search ..... 53/35, 59 R, 202, 244, 53/250, 252, 263

[56] References Cited

U.S. PATENT DOCUMENTS

| | | | |
|---|---|---|---|
| 2,941,343 | 6/1960 | Cantrell | 53/263 |
| 2,966,017 | 12/1960 | Gallagher | 53/263 X |

*Primary Examiner*—Robert Louis Spruill
*Attorney, Agent, or Firm*—H. Wayne Rock

[57] ABSTRACT

Apparatus and method is disclosed for loading a plurality of bales or containers containing pouches filled with a liquid such as milk into a rectangular open-top case. An empty case is located on the apparatus and a rotatable divider is positioned on the case to create suitable bale-receiving compartments. The bales are fed to a diverter which moves each bale to a position overlying an empty compartment so that the bale falls into the compartment. The divider then rotates to rotate the case to bring another empty compartment into registry with the diverter. This repeats until the case is full, at which time the divider is withdrawn vertically from the case and the full case is fed to an outlet conveyor. An empty case is brought to a position below the raised divider, the divider is lowered into the empty case and the filling process is repeated. The case has been filled symmetrically and is easy to handle thereafter.

9 Claims, 13 Drawing Figures

METHOD AND APPARATUS FOR CASING FLEXIBLE CONTAINERS

The present invention relates to the packaging of flexible containers in general and in particular to the packaging of pouches of milk contained in an overbag into rectangular cases.

BACKGROUND OF THE INVENTION

Canadian Pat. No. 1,008,040 issued on Apr. 5, 1977 describes apparatus for packaging a plurality of pouches of a liquid such as milk in an overbag. The pouches usually contain a quart of milk each and subsequent to the overbagging operation the overbags are sealed and are fed to a loading station. At the loading station the overbags are manually placed in cartons or crates for transport to the dairy.

Recently dairies have invested heavily in rectangular plastic cases for the transport of milk in one, two or three quart cartons. The cases are sized so that a fixed quantity of the milk cartons can be located therein with little or no lost space. The cases are stackable and easily handled both in the dairy and in the retail outlet. With the increase in popularity of the overbag and pouch packaging of milk it becomes desirable to utilize these cases for the packaging of such overbags. It becomes even more desirable to depart from the practice of manually loading the overbags in their transport cartons in view of the extremely high speeds of the pouching equipment (approaching 100 pouches per minute).

SUMMARY OF THE INVENTION

The present invention fulfils this need by providing an automatic mechanical device which will load four overbags herein designated as "bales", each containing three one-quart pouches in the standard dairy case now in use. The bales are symmetrically loaded in the case so that the case is fully balanced and hence easy to handle. There will be no damage to the bales, or their contents, always a consideration when manual methods are used, and the speed of the loading operation will be such as to keep up with the overbagging equipment.

In its basic form the present invention contemplates a method of loading a plurality of flexible containers symmetrically in a generally rectangular open-top case comprising the steps of: a) locating removable divider means in said case, said divider means forming a plurality of symmetrically positioned compartments in said case; b) loading said compartments with said containers, with one container per compartment; and, c) removing said divider means from said case, leaving said containers in position in the case.

The method of the present invention may be carried out by a loading device for locating a plurality of flexible containers symmetrically in a generally rectangular open-top case comprising: a framework; means for locating an empty case in the framework; divider means positionable in the case, dividing the case into a plurality of compartments each sized to receive one of the containers; conveyor means for feeding containers into said framework; diverter means for moving a container from the conveyor means to a position overlying an empty compartment so that the container will fall into the empty compartment; means for rotating the divider means and the case to index the compartments; means for removing the divider means from the case when all compartments are full; and, means for removing the full case from the framework.

In one embodiment the main components are connected to an open framework with the containers or bales travelling from the overbagger along a conveyor which terminates in the framework at an elevation corresponding essentially to the top edge of the sides of the dairy case. The case is located on a flat surface within the framework adjacent the inlet conveyor and with one side parallel to the conveyor. A divider assembly is connected to the framework so that the divider itself can be raised or lowered with respect to the interior of the case. The divider includes a central vertical hub with a plurality of vanes extending therefrom, sized so that when the divider is within the case an adjacent pair of vanes will form a compartment with two sides of the case, the compartment being open at the top. Thus if the hub has four vanes there will be four compartments formed in the case, the compartments being symmetrical with respect to the hub. The vanes extend out from the hub a distance sufficient that their outer edges are in very close proximity to the inside walls of the case. A diverter is positioned at the end of the inlet conveyor to receive a bale brought from the overbagger. The diverter can move the bale to a position overlying an empty compartment so that the bale will fall into the compartment when the diverter is aligned with the compartment. The return of the diverter to its original position causes the operation of an indexing mechanism which rotates the divider, and in turn the cse, so that another empty compartment is brought into a position to receive a bale. Once the divider has rotated a predetermined number of times the compartments will all be full and the divider will be removed upwardly from the case, leaving the case with the bales therein. As the divider vanes depart the flexible nature of the bales will permit each bale to expand into contact with two adjacent bales and the frictional contact established thereby will tend to reduce any movement of the bales within the case. Once the divider is clear of the case the full case is removed from the framework and a new empty case takes its place.

BRIEF DESCRIPTION OF THE DRAWINGS

FIG. 3*e*, appearing on the same sheet as FIG. 3, shows a perspective view of the indexing mechanism.

DETAILED DESCRIPTION OF THE DRAWINGS

Figure 1:
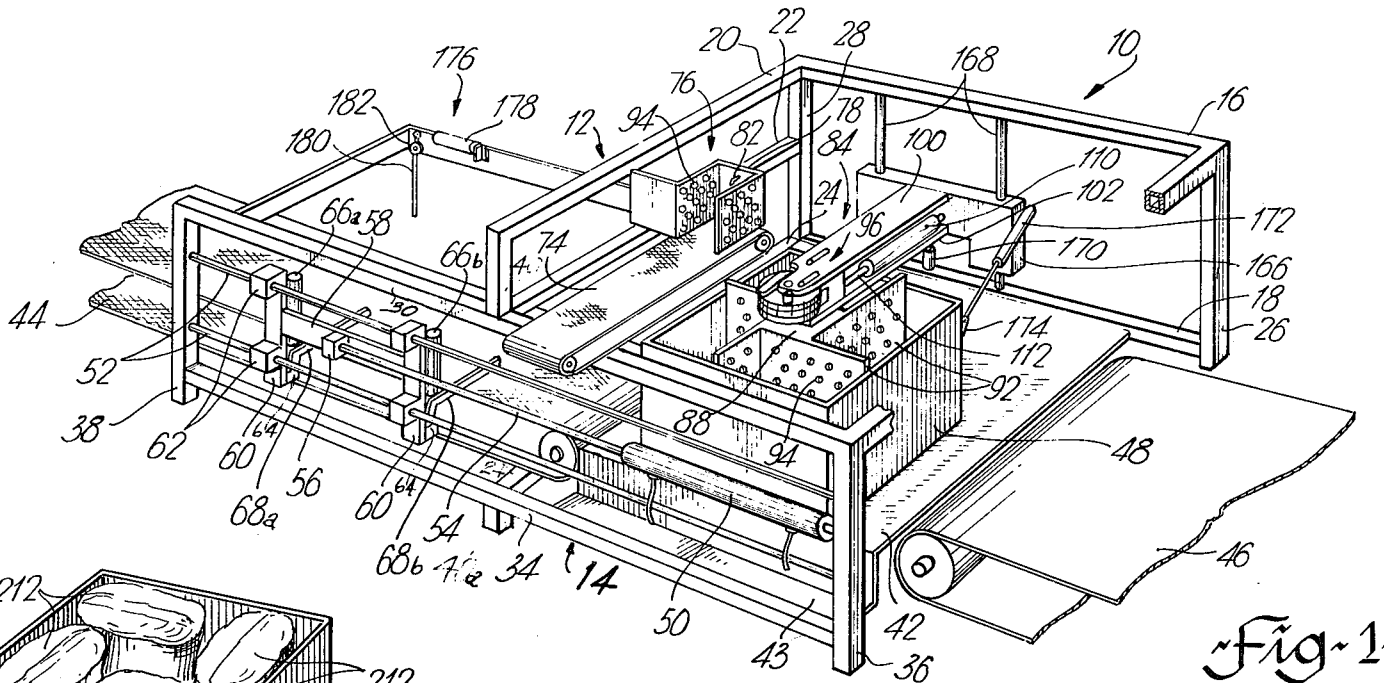
FIG. 1 shows a perspective view of the apparatus of the present invention.

FIG. 1 shows a perspective view of the apparatus of the present invention wherein it is seen that there is a main framework 10 which includes a first, generally L-shaped portion 12, in plan, and a second side portion 14. Thus portion 12 includes horizontal side members 16, 18, 20, 22, 24 and upright members 26, 28 while portion 14 includes horizontal side members 30, 34 and upright members 36, 38, 40 40*a*. Also included as part of the framework is an operating platform 42 forming a base for the open area of the apparatus, an inlet conveyor 44 and an outlet conveyor 46. The inlet conveyor 44 brings in an empty case 48, between frame members 22 and 24 and outlet conveyor 46 will take a full case away from platform 42.

Drive for the cases is provided by a drive cylinder 50 which is mounted horizontally between frame members 30 and 34. The mounting means is conventional and has been omitted for the sake of clarity. Also mounted between frame members 30 and 34, and anchored to upright members 36 and 38 is a pair of guide rods 52. In the embodiment according to FIG. 1 cylinder 50 is positioned between the guide rods 52.

The piston rod 54 of cylinder 50 is connected at its free end to a lug 56 affixed to a generally horizontal connecting bar 58. At each end of bar 58 there is an upright mounting bar 60 which carries a pair of journal bearing blocks 62, journaled to the guide rods 52. Each mounting bar carries a generally upright cylinder 66*a* or 66*b* with its piston rod pointing downwardly and connected at its free end to the bell crank portion 64 of a corresponding push bar 68*a* or 68*b*. The bell crank portions 64 are each journaled between a pair of brackets 70 projecting outwardly from the bottom portion of the respective mounting bar 60 (see FIG. 2). It should be pointed out that platform 42 is provided with a trough portion 43 along one side thereof, the trough providing clearance for bell crank portions 64 during reciprocation of the push bar assembly.

Mounted in the framework, as to frame members 22 and 30 is an inlet conveyor 74, the drive for which is not shown. Mounted to the framework above the inlet conveyor 74 is a diverter assembly 76 which includes a generally U-shaped diverter 78, a power drive means such as cylinder 80 (FIG. 2) and a switch 82 mounted within diverter 78. The cylinder 80 and diverter 78 are mounted so that operation of the cylinder can move the diverter from a position overlying conveyor 74 to a position overlying the operating platform 42. Diverter 74 is open both top and bottom and its open side faces upstream along conveyor 74.

Also mounted in the framework 10 is the divider assembly 84. The assembly includes a divider 86 having a central, generally rectangular hub 88 with a coaxial shaft 90 keyed thereto and extending vertically therefrom. Each vertical side of hub 88 has a vane 92 which appears as an extension of the hub side, the vanes being mutually perpendicular to each other. Each vane is perforated by a plurality of through holes 94, as is diverter 74. It should be pointed out that the length of each vane 92 is such that with the entire divider located within a case and the vanes being essentially parallel to the case sides the outer edge of each vane will almost touch the adjacent side of the case.

Connected to the shaft 90 is a indexing mechanism or drive assembly 96 which will impart rotational movement to the divider 86. Assembly 96 includes a housing 98 having top and bottom plates 100 and 102 respectively. (FIGS. 3, 3*a*, 3*b*, 3*e*.) The housing encompasses shaft 90 as by stepped bearing 104, there being one bearing associated with each of the top and bottom plates. Each bearing has a central bore 105 sized to receive shaft 90 therethrough for rotation therein. Top plate 100 is also provided with two longitudinally directed slots 106, 108, one being approximately centered therein, the other being offset to one side.

Within housing 98 is a drive cylinder 110 anchored thereto as by a bracket (not shown) and having its piston rod 112 directed towards shaft 90. The free end of piston rod 112 is threaded into a block 114 which is slidably received in the housing 98. Block 114 is shown in greater detail in FIG. 4 wherein it is seen to include a main section 116 to which rod 112 is connected as by threaded hole 118, and a pair of plates 120 each carrying a pair of forwardly projecting arms 122 and 124 respectively. Main section 116 also includes stud 126 threaded therein to be receivable in slot 106 to guide block 114 in reciprocating motion within housing 98. The limits of the reciprocating motion of block 114 are established by the length and position of slot 106.

Figure 4:
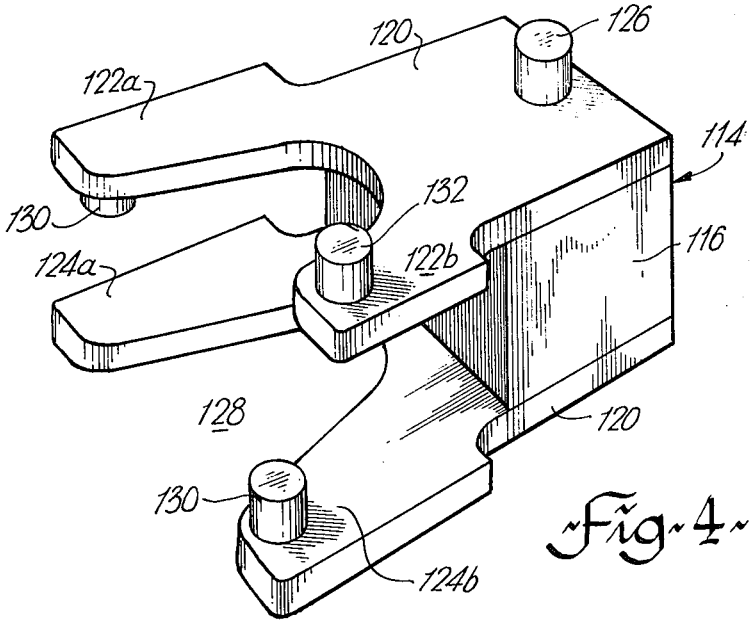
FIG. 4 shows a perspective view of a sliding block used in the indexing mechanism.

As mentioned previously plates 120 carry a pair of arms each projecting forwardly therefrom. Arms 122 extend from the upper plate 120 while arms 124 extend from the lower plate 120. As seen in FIG. 4, the plates 120 are essentially identical but they are of opposite hand in position, that is, arm 122*a* is similar to arm 124*b* and arm 122*b* is similar to arm 124*a*. There is a gap 128 between the left and right arms, that gap being greater than the diameter of bushings 104. FIG. 4 illustrates as weel that each of the arms 122*a* and 124*b* carries a cylindrical stud 130 which projects inwardly towards the arm directly opposite while the arm 122*b* carries a cylindrical stud 132 which projects outwardly therefrom, stud 132 being positioned for reception in slot 108 of top plate 100.

Figure 3:
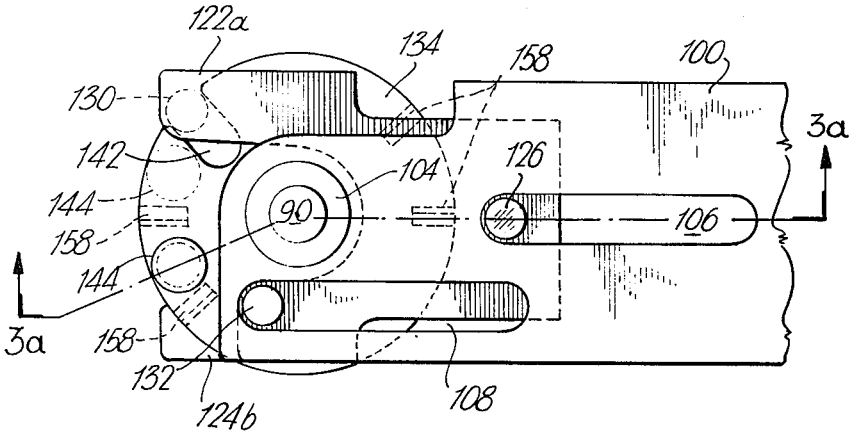
FIG. 3 shows a plan view of the indexing mechanism.
Figure 3A:
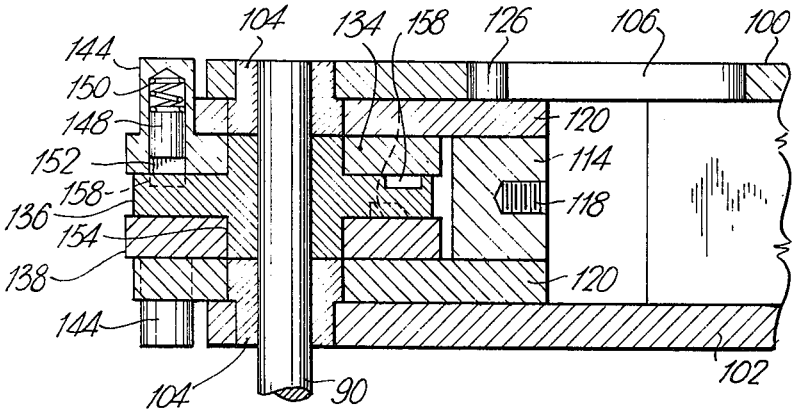
FIG. 3*a* shows a section of the indexing mechanism along the line 3*a*—3*a* of FIG. 3.
Figure 3C:
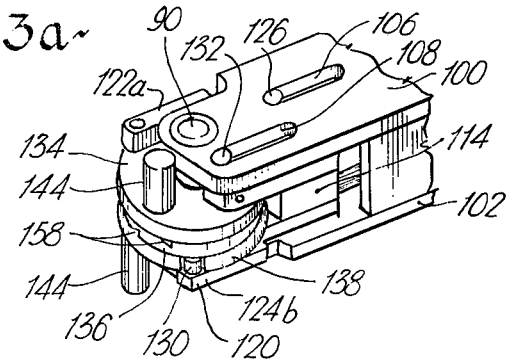
FIGS. 3*c* and 3*d* show perspective view of plates used in the indexing mechanism.
Figure 3B:
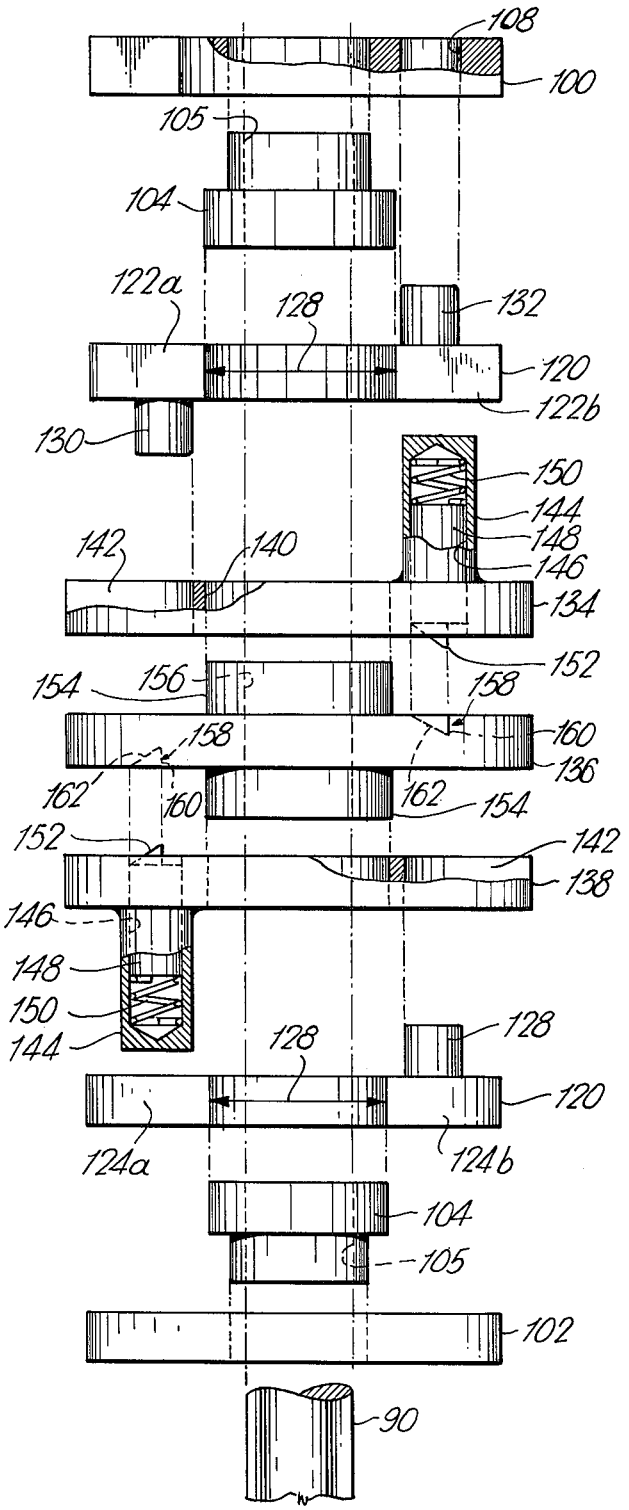
FIG. 3*b* shows an exploded end view of the indexing mechanism.
Figure 3C:
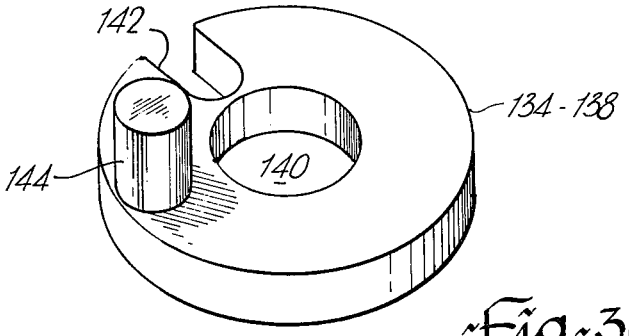

Sandwiched between the upper arms 122 and the lower arms 124 are three circular plates 134, 136 and 138 (FIGS. 3*a* and 3*b*). Plates 134 and 138 are similar and are shown in plan view in FIG. 3*c* while plate 136 is shown in plan in FIG. 3*d*. Plates 134, 138 have a central opening 140, a radially directed slot 142 sized to receive a stud 130 and a projecting cylindrical housing 144 extending from one planar surface adjacent the periphery. Housing 144 has a cylindrical bore 146 communicating therefrom through the plate body, the bore 146 receiving a plug 148 slidable therein. The plug is biased outwardly of the housing 144 by a compression spring 150. The outer end of each plug carries a male ratchet tooth 152, generally triangular in profile.

Figure 3D:
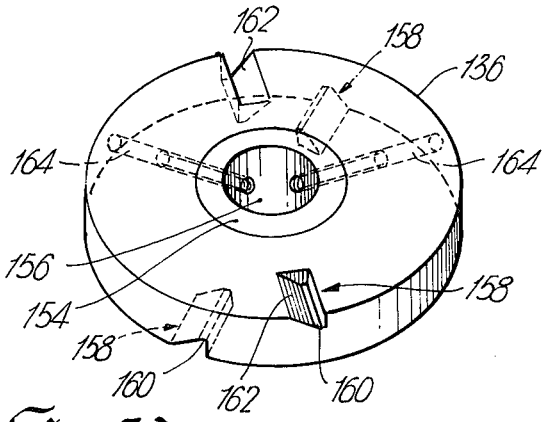

Plate 136, shown in FIGS. 3*a*, 3*b* and 3*d* is slightly smaller in diameter than plates 134, 138 and has a central boss 154 projecting outwardly from each surface (FIGS. 3*a* and 3*b*). The diameter of each boss is such as to be receivable in bore 140 in each of the plates 134, 138 to act as a bushing therefor. In addition there is a bore 156 extending through the bosses 154 and plate 136 so as to receive shaft 90. The upper and lower surfaces of plate 134 each carries a pair of diametrically opposed female ratchet teeth 158, each tooth including a generally vertical section 160 and a sloping section 162. As can be seen in FIG. 3*d* the upper and lower teeth are circumferentially offset from each other but they are all oriented so as to impart uniform rotation to plate 136, counterclockwise as in FIG. 3*d*. Shaft 90 can be keyed to plate 136 so as to rotate therewith by utilizing set screws receivable in threaded radial holes 164.

Figure 2:
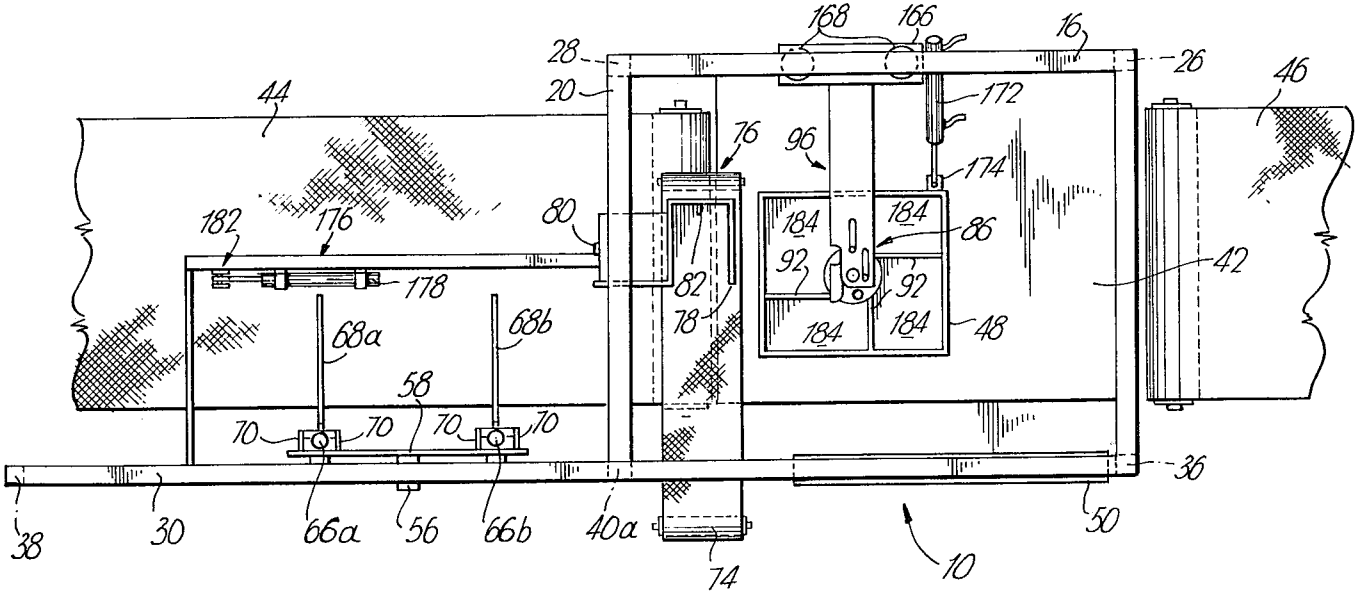
FIG. 2 shows a plan view of the apparatus of FIG. 1.
Figure 6:
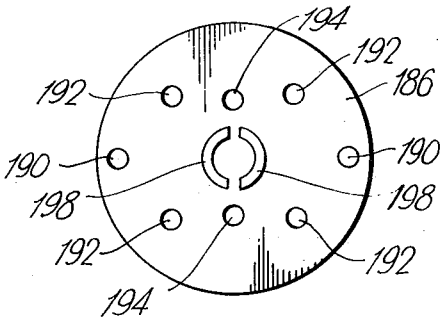
FIG. 6, appearing on the same sheet as FIG. 2, shows a plan view of the timing wheel utilized as part of the control circuit.

Reverting to FIGS. 1 and 2 it is seen that drive assembly 96 is connected to a bearing block 166 which is adapted for vertical reciprocating movement on a pair of vertically oriented guide rods 168 held between frame members 16 and 18. A vertically oriented drive cylinder 170 is positioned between frame member 18 and bearing block 166 to impart the vertical reciprocating movement to the bearing block 166 and the drive assembly 96. Another cylinder 172 is affixed to one edge of bearing block 166, the cylinder having a stop face 174 at its free end adapted to engage the side surface of a case 48.

Finally an L-shaped framework 176 is affixed to frame members 22 and 30 so as to be supported above inlet conveyor 44. Framework 176 carries a cylinder 178 which is connected via a clevis to a rod 180 which in turn can pivot on pin 182 between generally vertical and generally horizontal attitudes.

The operation of the present invention will now be described with reference to the simplified schematic of FIG. 5 and the structural details of FIGS. 1 to 6. It is assumed that divider assembly 96 is in a lowered position (cylinder 170 retracted) in a case 48 with the divider vanes located as shown in FIGS. 1 and 2, defining four compartments 184. It is seen from FIG. 2 that the compartments 184 are elongated with the major axis of each being perpendicular to that of the adjacent compartment. It is also assumed that there is an empty case positioned between push arms 68*a* and 68*b.*

Figure 5:
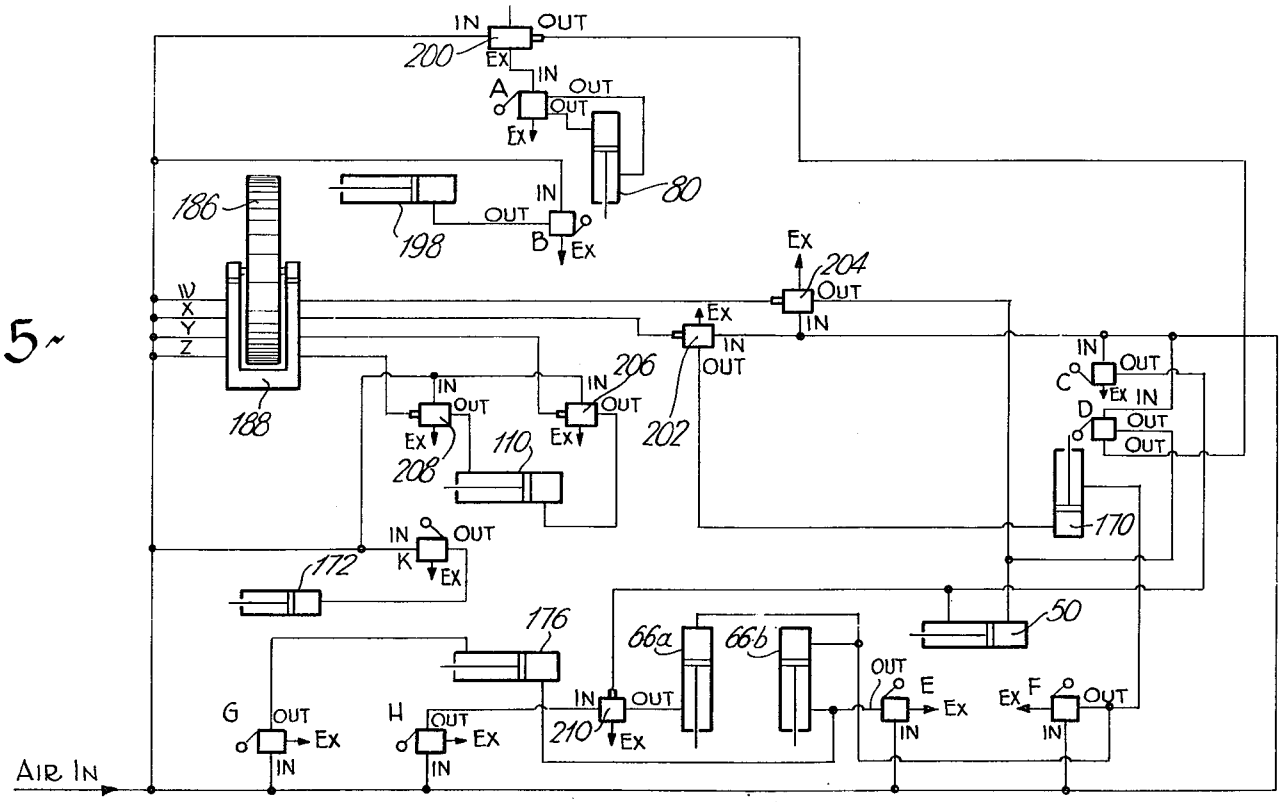
FIG. 5 shows the pneumatic circuit which controls the operation of the present invention.

Control of the sequence of operations is provided by a timing wheel 186 (FIG. 6) mounted for rotation in a yoke 188 (FIG. 5). Timing wheel 186 has a plurality of apertures arranged at various locations concentric to the rotational axis, namely outer apertures 190 (two in number), adjacent apertures 192 (four in number), inner apertures 194 (two in number), and innermost segmental apertures 198 (two in number). The angular separation between apertures 190, 192, 194 is 45°. Rotation of timing wheel 186 is provided by a spring return cylinder 198 operating through a ratchet mechanism (not shown) so that rotation of the timing wheel is unidirectional.

Referring now to FIG. 5 pressurized air is provided via the conduit labelled "AIR IN", that air being directed to yoke 188 via four vertically aligned branch lines W, X, Y, Z, to pilot valves 200, 202, 204 and to mechanical valves B, C, D, E, F, G and H.

With the divider assembly positioned as mentioned above, a full bale is directed along conveyor 74 until it enters diverter 78 and actuates mechanical switch 82 ("A" in FIG. 5). "A" is a 4-way spring operated valve and it normally is open to ensure that diverter cylinder 80 is retracted. Actuation of valve A pressurizes cylinder 80 to move the diverter from a position overlying conveyor 74 laterally (to the right as in FIG. 2) to a position overlying the adjacent compartment 184 in case 48. The bale drops into the compartment releasing switch A and causing the retraction of cylinder 80. During the retraction of cylinder 80 a cam mounted on the rod thereof activates mechanical switch B which in turn pressurizes cylinder 198 to rotate timing wheel 186 through 45°. This rotation brings an aperture 192 into alignment with branch line Y providing a pneumatic connection with pilot valve 206 which permits drive cylinder 110 to extend. Extension of drive cylinder 110 causes stud 130 on arm 122*a* and stud 130 on arm 124*b* to engage via slots 142 in their respective plates 134 and 138 causing plate 134 to rotate counterclockwise and plate 138 to rotate clockwise (as in FIG. 3). Rotation of plate 134 brings the male ratchet tooth 152 extending therefrom into registry with one of the female ratchet teeth 158 on the upper surface of plate 136 causing counterclockwise rotation thereof. The male ratchet tooth 152 on plate 138 is driven back into its bore 146 as it rides across the lower surface of plate 136. At the full extension of cylinder 110 the lower ratchet teeth will engage and the divider assembly, via shaft 90 and hub 88 will have rotated through 90°, causing rotation of case 48 also through 90° to thereby bring an empty compartment 184 adjacent diverter 78.

During extension of cylinder 110, a mechanical switch K is actuated to cause operation of cylinder 172, the stop face of which engages the side of case 48 to aid in the rotation thereof. Switch K remains actuated only during a portion of the extension of cylinder 110 and hence when the case has reached its desired orientation switch K is deactivated and cylinder 172 returns to its retracted position under the influence of an internal spring.

The second bale, entering diverter 78 sets the above steps in motion again with the exception that rotation of the divider assembly and the case is achieved by retraction of cylinder 110 with plate 136 and shaft 90 being driven by engagement of the lower ratchet teeth 152, 158. Thus plate 138 rotates counterclockwise and plate 134 rotates clockwise, with the upper male tooth 152 riding over the upper surface of plate 134 to eventually engage in the diametrically opposed female tooth 158. Control for this portion of the operation is achieved since the next aperture 190 has come into registry with branch line Z causing operation of pilot valve 208, pilot valve 206 being inoperative.

The third bale repeats the operation initiated by the first bale, as the next aperture 192 is brought into registry with branch line Y and cylinder 110 again retracts to rotate the divider assembly through 90°, bringing the last compartment 184 adjacent diverter 78.

During the foregoing steps, segmental aperture 196 has been in registry with branch line W and hence cylinder 50 has been in an extended position, controlled by pilot valve 204.

When the fourth bale has entered its compartment, aperture 194 is brought into registry with branch line X and pilot valve 202 is actuated to pressurize cylinder 170, extending the cylinder and raising the divider assembly 84 so that divider vanes 92 leave the full case.

Since there are empty cases waiting in line mechanical switch G will have been depressed by a waiting empty case so as to retract cylinder 178 causing stop rod 180 to enter the case approaching push bar 68*a* and prevent its inadvertent entry into the ready area between bars 68*a* and 68*b* inasmuch as inlet conveyor 44 is always operating. There will, of course be a case in the ready area between arms 68*a* and 68*b,* arm 68*b* being normally down due to retraction of the cylinders 66*b.* This is controlled by mechanical switch E which is actuated when cylinder 50 is in its extended position. Thus, when the divider assembly has lifted out of the full case, cylinder 50 is still extended, push bar 68*b* is down and there is a case between bars 68*a* and 68*b.* This latter case will depress switch H which, if pilot valve 210 is operated will cause cylinder 66*a* to retract and lower push bar 68*a* behind that case.

When lift cylinder 170 has reached full extension it will operate switch C which causes cylinder 50 to retract and pilot valve 210 to permit the lowering of arm 68*a*. Arm 68*b* is already lowered (via switch E) and hence arm 68*b* will engage the full case as arm 68*a* engages the next empty case, both cases progressing in the same direction so that the full case is fed to the output conveyor 46 and the empty case is brought into the operating position below divider assembly 84. When cylinder 50 is fully retracted switch F is activated to cause divider 86 to lower into the empty case and cylinders 66*a*, 66*b* to extend, bringing arms 68*a*, 68*b* to a vertical orientation so that they can bypass the empty case and the next case to enter into the ready position between arms 68*a*, 68*b*. Retraction of cylinder 170 activates switch D to cause extension of cylinder 50 to its ready position. When switch E is again struck it will cause the lowering of arm 68*b* and the raising of arm 180 so that the next empty case can enter the ready area. The case following that case engages switch G to bring the stop arm 180 again to its lowered position.

It should also be pointed out that switch D is a 4-way switch and that when cylinder 170 is extended it operates pilot valve 200 to disable switch A so that no bales will be inadvertently deposited in the mechanism during the case-changing sequence.

Figure 7:
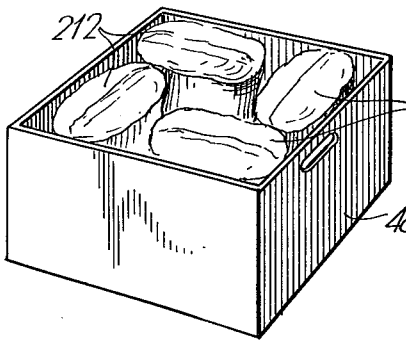
FIG. 7, appearing on the same sheet as FIG. 1, shows a view of a case containing four bales.

The result of the above operation is shown in FIG. 7 with there being four bales 212 of packaged milk in a case 48, the bales being symmetrically positioned for ease of handling.

Figure 8:
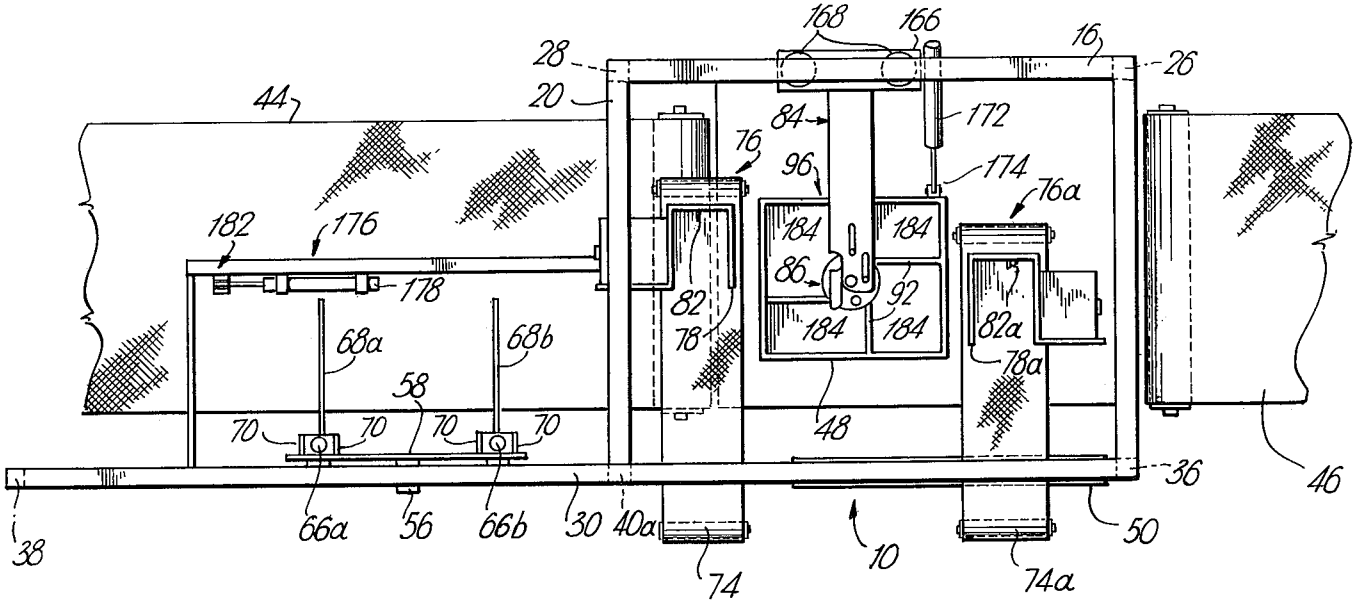
FIG. 8 shows a plan view of a second embodiment of the present invention.

A second embodiment is illustrated in plan view in FIG. 8 wherein it is seen that a second inlet conveyor 74*a* is located so that its diverter 78*a* will deposit a bale in a compartment 184 diametrically opposed to the compartment filled by diverter 78. Thus two compartments can be filled simultaneously and it is only necessary to rotate the divider and case through 90° before the case is filled as opposed to 270° of rotation when only a single diverter is used. This embodiment would require a new timing wheel 186 but such would be easy to devise.

It is evident from the above that variations in the basic invention are possible and may occur to someone skilled in the art. For example the pneumatic circuitry could be simplified by replacing the timing wheel with a camming mechanism. This would reduce the complexity of the circuit and would also result in perhaps a more positive operation by avoiding the possibility of misalignment between the conduits W, X, Y, Z, and the appropriate aperture in the timing wheel 186. Accordingly the scope of protection to be afforded the present invention should be determined only from the appended claims.

I claim:

1. Loading device for locating a plurality of flexible containers symmetrically in a generally rectangular open-top case comprising:

a framework;

means for locating an empty case in said framework;

divider means positionable in the case, dividing the case into a plurality of compartments each sized to receive one of said containers;

conveyor means for feeding containers into said framework;

diverter means for moving a container from said conveyor means to a position overlying an empty compartment so that the container will fall into the empty compartment;

means for rotating the divider means and the case to index the compartments;

means for removing the divider means from the case when all compartments are full; and, means for removing the full case from the framework.

2. The loading device of claim 1 wherein said divider means comprises a hub rotatable on a shaft and a plurality of vanes extending outwardly from said hub, said vanes defining inner walls of said compartments, the walls of said case defining outer walls of said compartments, said vanes when in said case and forming said compartments being closely adjacent the sides of said case.

3. The loading device of claim 2 wherein said shaft is keyed to said means for rotating said divider means.

4. The loading device of claim 2 wherein said rotating means includes a drive cylinder having a drive rod reciprocable thereby, a control block connected to said rod, a pair of rotatable drive plates connected to said control block for rotation thereby, said control block being adapted to rotate one of said plates clockwise and the other of said plate counterclockwise upon sliding movement in one direction and to reverse the rotation of each plate upon sliding movement on the opposite direction, a connector plate positioned between said drive plates and keyed to said shaft and releasable drive means on each of said drive plates for predetermined driving connection with said connector plate during rotation of said drive plates.

5. The loading device of claim 4 wherein said releasable drive means includes, for each of said drive plates, a male ratchet tooth contained in a housing on the drive plate and biased outwardly of the housing towards the adjacent surface of said connector plate, the connector plate including at least two female ratchet teeth in the adjacent surface for driving engagement with the respective male ratchet tooth, the female ratchet teeth on both surfaces of said connector plate being oriented in the same direction so that a drive imparted by rotation of the male ratchet tooth on one of said drive plates is accompanied by non-engagement of the male ratchet tooth on the other of said drive plates with the corresponding female ratchet tooth, whereby rotation of said connector plate and said shaft is unidirectional, independent of the direction of rotation of said drive plates.

6. The loading device of claim 2 wherein said diverter means includes a generally U-shaped diverter open on top, bottom and on one side, said diverter overlying said conveyor means with the open side thereof facing upstream of the conveyor means to receive a container carried thereinto by the conveyor means, a diverter drive cylinder operable to displace said diverter laterally to the position overlying an empty compartment in the case, and switch means within the diverter actuable by a container entering the diverter to control the operation of said diverter drive cylinder.

7. The loading device of claim 1 wherein said locating and removing means comprises a drive cylinder mounted horizontally in said framework and having a piston rod connected to a drive assembly, said drive assembly including a pair of horizontally spaced generally vertical mounting bars each carrying a vertically oriented drive cylinder, each of said latter drive cylinders being connected to one end of a pivotally mounted push bar so that each bar may be moved between a generally vertical ready position and a generally horizontal push position with one of said push bars being engagable with a full case and the other of said push bars being engagable with an empty case whereby upon actuation of the former drive cylinder the full case can be removed and the empty case can be located below said divider means following removal of the divider means from the full case.

8. Loading device for locating a plurality of flexible containers symmetrically in a generally rectangular open-top case comprising:

a framework;

means for locating an empty case in the framework;

divider means positionable in the case, dividing the case into a plurality of compartments each sized to receive one of the containers;

a pair of spaced inlet conveyors for feeding containers into said framework adjacent two opposed sides of said case;

diverter means for each of said conveyors, each diverter means being adapted to direct a container from the corresponding conveyor to a position overlying an adjacent empty compartment so that the container will fall into the empty compartment;

means for rotating the divider means and the case to bring empty compartments into a position adjacent said conveyors;

means for removing the divider means from the case when all compartments are full; and, means for removing the full case from the framework.

9. A method of loading a plurality of flexible containers symmetrically in a generally rectangular open-top case comprising the steps of:

a. locating removable divider means in said case, said divider means forming a plurality of symmetrically positioned compartments in said case;

b. feeding said containers singly to laterally displacable diverter means, c. displacing said diverter means laterally so as to overlie an empty compartment in said case;

d. releasing the container from the diverter means to fall into said empty compartment;

e. rotating said divider means and said case to bring a new empty compartment to a position adjacent said diverter means;

f. repeating said feeding, displacing, releasing and rotating steps until each compartment is full; and g. removing said divider means from said case, leaving said containers in position in the case.

* * * * *